US012480216B2

(12) United States Patent
Henderson et al.

(10) Patent No.: US 12,480,216 B2
(45) Date of Patent: Nov. 25, 2025

(54) DUAL MODE CORROSION INHIBITOR FOR HYDROCARBON PROCESSES

(71) Applicant: CHEMTREAT, INC., Glen Allen, VA (US)

(72) Inventors: William Henderson, Richmond, VA (US); Patrick Wood, Richmond, VA (US)

(73) Assignee: CHEMTREAT, INC., Glen Allen, VA (US)

( * ) Notice: Subject to any disclaimer, the term of this patent is extended or adjusted under 35 U.S.C. 154(b) by 560 days.

(21) Appl. No.: 16/916,859

(22) Filed: Jun. 30, 2020

(65) Prior Publication Data

US 2021/0002773 A1 Jan. 7, 2021

Related U.S. Application Data

(60) Provisional application No. 62/869,261, filed on Jul. 1, 2019.

(51) Int. Cl.
*C23F 11/04* (2006.01)

(52) U.S. Cl.
CPC ..... *C23F 11/04* (2013.01)

(58) Field of Classification Search
CPC ..... C23F 11/04; C23F 11/184; C23F 11/149; C23F 11/08; C09K 8/54
See application file for complete search history.

(56) References Cited

U.S. PATENT DOCUMENTS

| | | | | |
|---|---|---|---|---|
| 3,301,323 | A * | 1/1967 | Parsons | C09K 8/54 175/38 |
| 4,317,742 | A * | 3/1982 | Yamaji | C10L 5/40 252/400.1 |
| 6,001,156 | A * | 12/1999 | Riggs, Jr. | C23F 11/08 106/14.44 |
| 6,475,431 | B1 * | 11/2002 | Naraghi | C23F 11/144 422/12 |
| 8,889,599 | B1 * | 11/2014 | McDaniel | C09K 8/502 166/305.1 |
| 9,480,946 | B2 | 11/2016 | Ramachandran et al. | |
| 2015/0004054 | A1 * | 1/2015 | Richardson | C02F 1/683 422/15 |
| 2015/0284859 | A1 * | 10/2015 | Erickson | C23F 11/18 252/389.23 |
| 2016/0145442 | A1 * | 5/2016 | Kalakodimi | C23C 22/68 427/327 |
| 2016/0215400 | A1 * | 7/2016 | Kalakodimi | C23F 11/08 |
| 2017/0159870 | A1 | 6/2017 | Budaragin et al. | |
| 2018/0100096 | A1 * | 4/2018 | Wylde | C07D 255/02 |

* cited by examiner

*Primary Examiner* — Lois L Zheng
(74) *Attorney, Agent, or Firm* — Oliff PLC

(57) ABSTRACT

A method of suppressing corrosion of a corrodible metal surface that contacts a fluid stream in a hydrocarbon system. The method includes introducing into the fluid stream a treatment chemistry including an organometallic corrosion inhibitor having a metal and an organic carboxylic acid. The organometallic corrosion inhibitor is hydrocarbon soluble and the metal is released from the organometallic corrosion inhibitor in the presence of water or $H_2S$.

22 Claims, No Drawings

DUAL MODE CORROSION INHIBITOR FOR HYDROCARBON PROCESSES

This application claims priority to Provisional Application No. 62/869,261, filed Jul. 1, 2019. The entire contents of the prior application are hereby incorporated by reference in its entirety.

TECHNICAL FIELD

This application is directed to methods and compositions for corrosion inhibitor treatment in fluid systems, such as those used in industrial hydrocarbon processes.

BACKGROUND

Carbon steel is the most commonly used material for construction of pipelines and associated production equipment. The presence of $CO_2$, $H_2S$ and water lead to significant corrosion. Corrosion can be controlled, in part, through design and selection of corrosion resistant materials, but capital costs can be significantly reduced with the use of lower alloyed steels in combination with an appropriate corrosion control practice. The use of corrosion inhibitors is one of the most practical and cost effective methods for combating corrosion in oil and gas wells and flowlines. A variety of organic compounds which generally contain nitrogen, oxygen, phosphorus, or sulfur heteroatoms act as corrosion inhibitors for steels. These compounds include amines, alkyl imidazoline salts, quaternary ammonium compounds, alkyl pyridinium salts, alkyl amides, triazoles, oxadiazoles, thiourea derivatives, thiosemicarbazide, thiocyanates, and the combinations thereof.

Imidazoline-based corrosion inhibitors are cationic surface active compounds widely used for protecting pipelines from corrosion in the oil and gas industry. The surfactants have an affinity to accumulate at the interface of immiscible fluids resulting in a corresponding lowering of the interfacial tension. Due to their surfactant nature, corrosion inhibitors adsorb at the interface between two phases such as air and water, oil and water, or solution and metal electrode and form a protective barrier against corrosive agents at the metal surface. The surface-active properties of corrosion inhibitors originate from their amphiphilic molecular structure comprised of a polar head group and a non-polar hydrophobic tail. The polar head group possesses a high affinity for a mild steel substrate through either non-specific (physisorption) or specific (chemisorption) processes. Due to its hydrophobic character, the hydrocarbon chain effectively disperses water and aqueous species from the steel surface.

Treatment of corrosion in fluid systems is typically achieved by continuous application of various corrosion inhibitors in the water including, for example, phosphates, polymer, chromates, zinc, molybdates, nitrites, amines, fatty acids, and combinations thereof. These inhibitors work by the principle of shifting the electrochemical corrosion potential of the corroding metal in the positive direction indicating the retardation of the anodic process (anodic control), or displacement in the negative direction indicating mainly retardation of the cathodic process (cathodic control). Corrosion inhibitors act on the cathode and/or anode of the corrosion cell.

Historically, the use of Tin compounds as a corrosion inhibitor has been the subject of some experimentation in industrial water systems. Stannous salts are known to inhibit corrosion in low TDS (total dissolved solids) water but, unlike more conventional corrosion inhibitors, the mechanism by which the stannous salts inhibited corrosion was not well understood. Previous corrosion inhibition programs utilized the stannous salts in much the same manner as conventional corrosion inhibitors in which doses of the stannous inhibitors were introduced into the aqueous systems to maintain a minimum stannous concentration in order to be effective.

Current hydrocarbon-based corrosion inhibitors such as dimer/trimer acids and imidazolines are primarily filming corrosion inhibitors. Over time, these corrosion inhibitors can fail and need to be reapplied. In this regard, the known methods have significant drawbacks when it comes to overall efficacy, safety, cost and delivery, particularly in the context of hydrocarbon systems.

Additionally, other methods for treating hydrocarbon systems involve "pigging." In this respect, "pigs" are placed inside the pipeline and forced through the pipeline by the pressure-driven flow. The pig cleans residue from the inner walls of the pipeline sections. "Chemical pills" may be used between two pigs to treat pipelines. Two pigs are used to sandwich the chemical and ensure it treats the full circumference of the pipeline. And corrosion inhibitors may be used in pigging operations to treat pipelines. But these methods are costly and risky. Moreover, there exists a need for more effective and durable corrosion and gunking treatment. These and other objectives are addressed by the disclosed embodiments.

SUMMARY

It is an object of the disclosed embodiments to provide corrosion inhibitors that are hydrocarbon soluble and form films on the surface of the pipeline, with the ability to breakdown and release additional, water soluble corrosion inhibitor in the presence of water or $H_2S$.

In an embodiment, there is provided a method of suppressing corrosion of a corrodible metal surface that contacts a fluid stream in a hydrocarbon system. The method comprises introducing into the fluid stream a treatment chemistry including an organometallic corrosion inhibitor having a metal and an organic carboxylic acid. The organometallic corrosion inhibitor is hydrocarbon soluble and the metal is released from the organometallic corrosion inhibitor in the presence of water or $H_2S$.

DETAILED DESCRIPTION

The disclosed embodiments provide methods for treating hydrocarbon systems with metallic carboxylate corrosion inhibitors. Metal carboxylates are metal salts of carboxylic acids. The corrosion inhibitor is hydrocarbon soluble (non-polar) or hydrocarbon dispersible and works by filming the metal surface. In the presence of water, the metal ion is hydrolyzed from the compound and released onto the metal surface in the aqueous phase, giving additional protection against corrosion.

Embodiments of the disclosed methods and compositions apply the discovery of improved corrosion inhibition to industrial fluid systems including, but not limited to hydrocarbon systems, cooling towers, water distribution systems, boilers, pasteurizers, water and brine carrying pipelines, storage tanks and the like. Embodiments of the methods and compositions are particularly useful in hydrocarbon processes. Improved corrosion inhibition can be achieved at lower cost and with less environmental impact by treating hydrocarbon systems with metal carboxylates. Disclosed embodiments form a very tenacious and persistent inhibitor film on the surface of corrodible metal by treatment with metal carboxylates, i.e., organometallic compounds comprising a fatty acid and metal component.

These treatment methods result in synergistic corrosion inhibition and a significant reduction in the amount of metal salt and fatty acid required, which is beneficial for the environment and reduces the cost of treatment. The methods provide for more economical treatment of large volume systems including, for example, once-through applications and other systems in which the water consumption and losses pose a significant challenge for dosage and control using conventional anti-corrosion treatments. The methods also greatly reduce the amount of other corrosion inhibitor(s), such as stannous salts, required to protect the treated system by reducing consumptive losses associated with oxidation and discharge of water from the system. This treatment method also allows for the metal salt to be selectively released (i.e., when it is needed) at the metal surface when in contact with water or $H_2S$.

The Metal Carboxylate

As used herein, metal carboxylates are organometallic compounds comprising a metal component with an organic carboxylic acid such as a fatty acid. The disclosed metal carboxylate may include any suitable reactive metal salt including, but not limited to, salts of metals listed in rows 4 and 5 of the periodic table. For example, the disclosed metal carboxylate may include tin, molybdenum, tungsten, manganese, boron, aluminum, zinc, zirconium, titanium, iron, and nickel. Indeed, embodiments of the disclosed methods should be operable with any metal salt capable of forming stable metal oxides resistant to dissolution under the conditions in the targeted system. The fatty acid may be any suitable carboxylic acid including branched chain and saturated fatty acids with a carbon chain of 4 to 50 carbon atoms, and preferably 5 to 20 carbon atoms. For example, the fatty acid may include naphthenic acids, cyclic acids (cyclohexanoic acid), maleic olefin copolymers, (polyisobtuylene succinic acid), laureth acids (such as laureth-7), other oxirane modified acids, ethoyxylated acids, octoic acid, propoxylated acids, oleic acid, neodecanoic acid and the like.

In embodiments, the metal carboxylate may be any hydrocarbon soluble metal carboxylate such as, for example, stannous octoate ($Sn[CH_3(CH_2)_3CH(C_2H_5)COO]_2$), stannous oleate ($SnC_{36}H_{66}O_4$), stannous neodecanoate ($Sn(C_{10}H_{19}O_2)_2$) or zinc octoate ($ZnC_{16}H_{30}O_4$). In preferred embodiments, the metal carboxylate is stannous octoate. It is believed that unique synergies are derived from the combination of tin and octoate.

Embodiments using stannous inhibitors are also beneficial if the effluent from the treated system is being used in a manner or for a purpose where a conventional inhibitor would be regarded as a contaminant or otherwise detrimental to the intended use. Such stannous-based corrosion inhibitors are more tolerant of overdosing when compared to conventional zinc or phosphate programs which rely on high volumes of polymeric dispersants to suppress formation of unwanted deposits.

Stannous corrosion inhibitors suitable for use with the disclosed methods may include Tin(II) compounds. Tin(II) is more soluble in aqueous solutions than a higher oxidation state metal ion, such as Tin(IV). For such metals, the lower oxidation state species can be introduced into the treated system by, for example, introducing a stannous salt directly or by feeding a concentrated solution into the treated system. Stannous salt treatments may work by any mechanism known in the art. For example, oxidizing species in the stannous salt treatment can convert the preferred Tin(II) stannous ions to largely ineffective (at least in the process fluid stream) Tin(IV) stannate ions.

Stannous compounds undergo oxidation at the vulnerable metal surfaces, or those surfaces in need of corrosion protection, and form an insoluble protective film. These metal surfaces can also react with the stannous compounds to form metal-tin complexes, which again form protective films on the metal surface. Stannous inhibitors applied in accordance with the disclosed methods form a protective film on reactive metals. The final result is a stannate film, Tin (IV), formed on or at the metal surface. The insolubility and stability of the resulting stannate film provides an effective barrier to corrosion for a limited time period even in the absence of additional stannous species being provided in the aqueous component of the treated system.

Additionally, in the presence of water or $H_2S$, the tin ion is hydrolyzed from the metal carboxylate compound by known chemical reactions. This releases additional tin and carboxylate onto the metal surface in the aqueous phase, giving further protection over conventional corrosion treatments. This chemistry is impactful because it can be fed to the hydrocarbon phase, while still readily giving protection in the aqueous phase. With conventional oilfield corrosion inhibitors, there is a balance between hydrocarbon solubility/dispersiblity and water solubility/dispersibility. In embodiments, there are components that are both fully water and oil soluble.

The Treatment Chemistry

The disclosed methods may include treating a hydrocarbon system with a treatment chemistry. The treatment chemistry may include the metal carboxylate alone, or, if desired, additional corrosion inhibition and/or fluid treatment chemistry known in the art can be introduced into the system in conjunction with the metal carboxylate to further improve corrosion performance and control deposition of undesirable species. As will be appreciated, the treatment methods according to the disclosure can be paired with other treatment or conditioning chemistries that would be compromised by the continuous presence of the corrosion inhibitor.

In embodiments, the disclosed metal carboxylate is mixed with one or more other compounds to formulate a treatment chemistry. These compounds serve to increase the overall anti-corrosion properties of the metal carboxylate by, for example, increasing the stability of the Tin(IV) film and improving water wetting and dispersion of the metal carboxylate in the aqueous medium. The treatment chemistry may include the metal carboxylate at any suitable concentration. For example, the metal carboxylate may be present in the treatment chemistry at a concentration in a range of 0.1 to 100 wt %, 0.5 to 75 wt %, 1.0 to 50 wt %, preferably 1.0 to 25 wt %, or more preferably 2.5 to 10 wt %. In this regard, it will be recognized that continuous feed and batch treating embodiments will require different concentrations. For example, in batch treatment, substantially pure metal carboxylate may be used, e.g., 25 to 100 wt %, 40 to 100 wt %, or 49 to 100 wt % solution. Continuous treatment embodiments may require substantially less metal carboxylate concentrate, e.g., in range of 0.1 to 25 wt %, 0.5 to 20 wt %, 1.0 to 10 wt %, 1.0 to 7.5 wt %, or 2.5 to 7.5 wt % solution. In some cases, continuous treatment concentrations may be used in batch treatment, i.e., 0.1 to 25 wt %, 0.5 to 20 wt %, 1.0 to 10 wt %, 1.0 to 7.5 wt %, or 2.5 to 7.5 wt % solution, in order to feed dilute solutions depending on system demand.

The treatment chemistry may include a co-inhibitor. For example, the treatment chemistry may include tall oil diethylenetriamine imidazoline (TOFA/DETA imidazoline) or other co-inhibitors such as TOFA/AEEA Imidazoline, substituted imidazolines, other fatty acids, dimer faty acids, trimer fatty acids, dimer/trimer fatty acid combinations, quaternary amines. TOFA is defined as a tall oil fatty acid with oleic acid as a major component. TOFA/DETA imidazoline is a water dispersible corrosion inhibitor. TOFA/DETA imidazoline is prepared by reacting tall oil fatty acid (TOFA), a mixture of oleic and linoleic acids, with diethylene triamine (DETA). The ratio of TOFA to DETA may be varied to give different properties. Generally, the more TOFA that is added, the more oil soluble the product is. A common formula is 2:1 TOFA:DETA imidazoline that is very oil soluble. In making the imidazoline (a closed ring structure), the first step is to make an amide (a open structure). Therefore, in any product, there is a mixture of open and closed molecules.

The treatment chemistry may include the co-inhibitor at any suitable concentration. For example, the co-inhibitor may be present in the treatment chemistry at a concentration in a range of 0.1 to 50 wt %, 0.5 to 20 wt %, preferably 1.0 to 10 wt %, or more or more preferably 2.5 to 10 wt %. The treatment chemistry may include the metal carboxylate and co-inhibitor at any suitable ratio. For example, the metal carboxylate and co-inhibitor may be present in the treatment chemistry at weight ratio in range of 100:0.1 to 0.1:100, 9:1 to 1:9, 4:1 to 1:4, 3:1 to 1:3, preferably 1:9 to 3:1, or more preferably 1:9 to 1:1.

In embodiments, the treatment chemistry may also include a solvent, which can be an organic solvent. For example, the treatment chemistry may include Aromatic 150 fluid or other solvents such as aliphatic solvents, aromatic solvents, mineral spirits, kerosene, diesel fuel, toluene, xylene, and alcohols. Aromatic 150 is a known solvent used in industrial applications such as fuel additives, paints and coatings, pesticides, industrial cleaning, mastics and sealants, and process fluids. Aromatic 150 is a combustible material in both the liquid and vapor forms, and has a relatively high vapor pressure. It is composed primarily of C10-12 alkyl benzenes. The treatment chemistry may include the solvent at any suitable concentration. For example, the solvent may be present in the treatment chemistry at a concentration in a range of 30 to 99 wt %, 50 to 98 wt %, preferably 60 to 95 wt %, or more preferably 70 to 90 wt %.

In embodiments, the treatment chemistry may also include other compounds as appropriate. For example, the treatment chemistry may include an anti-gunking compound such as, for example, mineral oil, heavy aliphatic oils, or low boiling solvents. Mineral oil helps to increase the anti-gunking properties of the treatment chemistry because mineral oil is not volatile at higher temperatures. In water or low boiling solvents, the solvent or water would evaporate as the treatment chemistry was injected into a production well, causing solids to precipitate out. The treatment chemistry may include the anti-gunking additive at any suitable concentration. For example, the mineral oil may be present in the treatment chemistry at a concentration in a range of 1 to 99 wt %, 10 to 95 wt %, preferably 15 to 90 wt %.

Additionally, "greener" treatment packages or treatment packages designed to address other parameters of the system operation can be utilized between the intermittent feedings of the treatment chemistry to improve the quality of the system effluent and/or reduce the need for effluent treatment prior to discharge.

The Treatment Method

The method and manner by which the treatment chemistry is infused into a fluid stream is not particularly limited by this disclosure. The treatment chemistry can be infused into the linepipes of the hydrocarbon system at any suitable valve location. The treatment chemistry can be added to a pure hydrocarbon or an emulsion of hydrocarbon based fluid and water. Methods for infusing the treatment chemistry, including controlling the flow of the infusion, may include a multi-valve system or the like, as would be understood by one of ordinary skill in the art. Moreover control of the treatment while in the system is not particularly limited.

Infusion control, including frequency, duration, concentrations, dosing amounts, dosing types and the like, may be controlled manually or automatically through, for example, an algorithm or a computer executable medium, such as a CPU. These controls may further be implemented with data and history-driven learning capabilities and feedback loops for automatically adapting treatment regimens to system conditions and metallic surface environmental conditions. The treatment can be continuous, intermittent or periodic. The treatment can be added to the fluid stream together with the co-inhibitor or other compounds, or each can be added separately.

Corrosion inhibitors are consumed within a treated system in various ways. These consumption pathways can be categorized as system demand and surface demand. Together, system demand and surface demand comprise total inhibitor demand. The amount of the treatment composition can be applied based on the system demand and surface demand for the metal carboxylate inhibitor. Controlling the amount of the treatment composition can utilize a number of parameters associated with surface and system demands including, for example, the concentration of corrosion products in the fluid or water or the demand of a surface of the metal for reduction species. Other parameters such as on-line corrosion rates and/or oxidation reduction potential (ORP) may also be used for controlling the treatment frequency or monitoring system performance.

The corrosion inhibitor composition may be shot-dosed, batch-fed, service-dosed or continuously fed. The frequency of dosing depends on the concentration of the dose, as disclosed herein, which in turn relates to whether the treatment is classified as being shot-dosed, batch-fed, service-dosed or continuously fed. In general, batch-feeding is considered to be a one-time dose or multiple doses separated by periods of time, e.g., 2 weeks to a year or longer. Continuous dosing occurs on a much more frequent schedule, e.g., 2 to 180 days, quarterly, weekly or daily. Continuous dosing may proceed by feeding product at a set ppm concentration relative to the system flow rates continuously, i.e., 24 hours a day for 7 days a week for a predetermined time period.

In conventional pigging applications, bi-annual or quarterly treatments are common, or in instances where corrosion is prevalent, weekly treatments may be made. In some systems, it may be beneficial to maintain some continuous level of active corrosion inhibitor in the fluid process stream after the treatment period. Maintaining a continuous low to very low level of active corrosion inhibitor after the treatment dosing may reduce the frequency at which subsequent treatments are needed. The duration, timing and concentration of the treatment doses can vary with the system demand as described herein.

As will be appreciated, the frequency of the combination feedings and the inhibitor concentrations necessarily will be a function of the system being treated and can be set and/or adjusted empirically based on test or historical data. In embodiments, the concentration of the inhibitor achieved during the treatment can be selected to exceed the baseline system demand and thereby ensure that a portion of the inhibitor fed is available to treat the vulnerable metal surfaces.

The duration of the treatment dosing can range from 5 minutes to 2 days, or more preferably, from 10 minutes to 24 hours, in the case of shot-dosing. In pigging environment, for example, the contact time from a pig run may only be seconds. The purpose of the pig is to leave a thin coat of product behind on the pipe walls. The pigs move through the line very quickly, but some product is left behind. The duration of service-dosing may be substantially the same or less depending on the target concentration requirements in the fluid stream. Similarly, the duration of continuous feeding treatments depend on system demand as discussed herein.

At the early stages of the treatment in a system with existing corrosion and/or exposed metal surfaces, the total inhibitor demand will be high but will decrease as metal surfaces are treated by the inhibitor treatment. A treatment end point is reached where all surfaces are treated and only the system (non-metal surface) demand remains. Once effective treatment is achieved using the treatment period(s), the system can be operated for extended periods without the need for any further addition of corrosion inhibitor or with a substantially reduced level of corrosion inhibitor.

In another embodiment, after the period where substantially reduced levels of corrosion inhibitor are added, the method may include introducing into the fluid stream the treatment composition over a second time period, during which a second concentration of the corrosion inhibitor in the fluid stream may be substantially the same or less than the initial concentration of the corrosion inhibitor. In the second time period, a second concentration of the corrosion inhibitor in the fluid stream may be substantially the same or less than the first concentration of the corrosion inhibitor. The duration of the second time period is not particularly limited and may be shorter of longer than the first time period depending on system requirements.

The success of the treatment may be evaluated by monitoring the total inhibitor demand which, when the surface demand is effectively suppressed or eliminated, will be essentially equal to the system demand. The system demand, in turn, can be measured indirectly by monitoring parameters such as corrosion rate by LPR or using a corrator, ORP and oxygenation levels. Thus, according to one embodiment, the treatment method may further comprise measuring and monitoring a characteristic of the metal surface or fluid stream during or after treatments to determine a time to initiate the treatment comprising the metal carboxylate, and/or a concentration of the metal carboxylate and other compounds in the treatment chemistry.

The treatment chemistry may be dosed into the fluid system at any suitable concentration. In continuous treatment embodiments, the treatment chemistry may be dosed into the fluid system at a concentration in a range of 1 to 1,000 ppm, 5 to 500 ppm, preferably 10 to 150 ppm, or more preferably 15 to 50 ppm. In batch-treatment embodiments, the treatment chemistry may be applied "neat" without any dilution, or at a concentration in the fluid stream in a range of 500 to 100,000 ppm, 1,000 to 50,000 ppm, or 2,000 to 30,000 ppm. In continuous treatment embodiments, the metal carboxylate may be dosed into the fluid system at a concentration in a range of 0.01 to 50 ppm, 0.025 to 25 ppm, 0.025 to 10 ppm, 0.1 to 4.5 ppm, 0.25 to 2.5 ppm, preferably 0.5 to 3.75 ppm, or more preferably 0.625 to 1.25 ppm. In batch-treatment embodiments, the metal carboxylate may be applied in pure form without any dilution.

In embodiments, the treatment chemistry may be introduced into open or closed fluid systems. Further, the treatment can be applied to the fluid stream while the fluid system is on-line. Alternatively, the treatment chemistry may be introduced into the fluid stream while the system is offline such as during pre-treating the corrodible metal surface before the equipment is brought into service in the fluid system. In preferred embodiments, the treatment chemistry is introduced into the linepipes of a hydrocarbon system while the system is online.

It is further contemplated that the disclosed methods and compositions may be applied according to known systems, which may be equipped with the capacity to monitor and control various aspects of the system operations including, for example, that the concentration of the metal carboxylate is sufficient, that the concentration of metal carboxylate does not exceed a target range, that the concentration of metal carboxylate is not excessive and/or that the efforts to remediate any residual metal carboxylate is efficient and effective.

EXAMPLES

The following data illustrate applications of the treatment methods disclosed herein with respect to various treatment chemistries.

Metal Carboxylate Efficacy Testing

Various treatment chemistries were tested on C1010 mild steel corrosion coupons in 1 L glass corrosion cells, at 40° C., 1 atm $CO_2$ constant blanket, for 3 days in synthetic water: NaCl (9.62%), $CaCl_2$ (0.305%)×$2H_2O$, $MgCl_2$ (0.186%)×$6H_2O$, and 250 ppm $NaHCO_3$. The treatment chemistries included an inhibitor, co-inhibitor and solvent. The inhibitor included various metal carboxylates and control samples. The co-inhibitor includes TOFA/DETA imidazoline and control samples. The solvent was Aromatic 150.

The following data illustrated in Table 1 compare treatment chemistries including metal carboxylate inhibitors according to disclosed embodiments to traditional oilfield treatment chemistries.

TABLE 1

Metal carboxylate efficacy testing.

| Sample | Dosage (ppm) | Inhibitor | Co-inhibitor | Aromatic 150 (wt %) | Corrosion Inhibition (%) |
|---|---|---|---|---|---|
| Example 1 | 25 | Stannous Octoate (wt 2.5%) | TOFA DETA Imidazoline (wt 7.5%) | 90.0 | 80.45 |
| Comparative Example 1 | 25 | — | TOFA DETA Imidazoline (wt 10%) | 90.0 | 62.14 |

TABLE 1-continued

Metal carboxylate efficacy testing.

| Sample | Dosage (ppm) | Inhibitor | Co-inhibitor | Aromatic 150 (wt %) | Corrosion Inhibition (%) |
|---|---|---|---|---|---|
| Comparative Example 2 | 25 | Dimer Acid (wt 10%) | — | 90.0 | −21.88 |
| Comparative Example 3 | 25 | Dimer Acid (wt 2.5%) | TOFA DETA Imidazoline (wt 7.5%) | 90.0 | 44.73 |
| Comparative Example 4 | 25 | Sodium Octoate (wt 10%) | — | 90.0 | −19.26 |

As seen in Table 1, the treatment chemistry according to the disclosed embodiments, i.e., Example 1 including stannous octoate (2.5%) resulted in 80.45% corrosion inhibition, which was significantly better than in the traditional oilfield chemistry of Comparative Example 1 including only TOFA/DETA imidazoline as an inhibitor, Comparative Example 2 including only dimer acid as an inhibitor, Comparative Example 3 including dimer acid as an inhibitor and TOFA/DETA imidazoline as a co-inhibitor and Comparative Example 4 including only sodium octoate as an inhibitor.

Metal Carboxylate Comparative Analysis

Various treatment chemistries were tested on C1010 mild steel corrosion coupons in 1 L glass corrosion cells, at 40° C., 1 atm $CO_2$ constant blanket, for 3 days in synthetic water: NaCl (9.62%), $CaCl_2$ (0.305%)×$2H_2O$, $MgCl_2$ (0.186%)×$6H_2O$, and 250 ppm $NaHCO_3$. The treatment chemistries included an inhibitor, co-inhibitor and solvent. The inhibitor included various metal carboxylates and control samples. The co-inhibitor includes TOFA/DETA imidazoline and control samples. The solvent was Aromatic 150.

Various treatment chemistries including metal carboxylate inhibitors according to disclosed embodiments were compared and are presented in the following Table 2.

TABLE 2

Metal carboxylate comparative analysis.

| Sample | Dosage (ppm) | TOFA DETA Imidazoline (wt %) | Metal Carboxylate (2.5 wt %) | Aromatic 150 (wt %) | Corrosion Inhibition (%) |
|---|---|---|---|---|---|
| Example 2 | 25 | 7.5 | Stannous Octoate | 90.0 | 96.06 |
| Example 3 | 25 | 7.5 | Stannous Oleate | 90.0 | 66.41 |
| Example 4 | 25 | 7.5 | Stannous Neodecanoate | 90.0 | 92.69 |
| Example 5 | 25 | 7.5 | Zinc Octoate | 90.0 | 65.26 |

As seen in Table 2, the treatment chemistries including stannous octoate (Example 2) and stannous neodecanoate (Example 4) exhibited better corrosion inhibition compared to the treatment chemistries including stannous oleate (Example 3) and zinc octoate (Example 5). In comparing Examples 2 and 4, these data suggest that octoate (Example 2) is a much better carboxylate to be paired with tin in a metal carboxylate than oleate (Example 3) and slightly better than neodecanoate (Example 4). Moreover, the data show that stannous octoate (Example 2) outperforms zinc octoate (Example 5), which suggest that unique synergies are derived from the disclosed stannous/fatty acid metal carboxylates.

Metal Carboxylate Ratio Optimization

Various treatment chemistries were tested on C1010 mild steel corrosion coupons in 1 L glass corrosion cells, at 40° C., 1 atm $CO_2$ constant blanket, for 3 days in synthetic water: NaCl (9.62%), $CaCl_2$ (0.305%)×$2H_2O$, $MgCl_2$ (0.186%)×$6H_2O$, and 250 ppm $NaHCO_3$. The treatment chemistries included an inhibitor, co-inhibitor and solvent. The inhibitor was stannous octoate. The co-inhibitor was TOFA/DETA imidazoline. The solvent was Aromatic 150.

Various treatment chemistries including stannous octoate, TOFA/DETA imidazoline and Aromatic 150 at various content ratios were compared and are presented in the following Table 3.

TABLE 3

Treatment composition ratio optimization.

| Dosage (ppm) | TOFA DETA Imidazoline (wt %) | Stannous Octoate (wt %) | Aromatic 150 (wt %) | Corrosion Inhibition (%) |
|---|---|---|---|---|
| 10 | 10.0 | 0.0 | 90.0 | 74.62 |
| 10 | 9.0 | 1.0 | 90.0 | 74.29 |
| 10 | 7.5 | 2.5 | 90.0 | 80.86 |
| 10 | 5.0 | 5.0 | 90.0 | 63.12 |
| 10 | 2.5 | 7.5 | 90.0 | 70.02 |

TABLE 3-continued

Treatment composition ratio optimization.

| Dosage (ppm) | TOFA DETA Imidazoline (wt %) | Stannous Octoate (wt %) | Aromatic 150 (wt %) | Corrosion Inhibition (%) |
|---|---|---|---|---|
| 10 | 1.0 | 9.0 | 90.0 | 57.21 |
| 10 | 0.0 | 10.0 | 90.0 | −7.92 |

As seen in Table 3, the treatment chemistry with 2.5 wt % of the metal carboxylate (i.e., stannous octoate) and 7.5 wt % of the co-inhibitor (i.e., TOFA/DETA imidazoline) exhibited the highest corrosion inhibition (80.86%). Additionally, the data show clear synergies resulting from the combination of stannous octoate and TOFA/DETA imidazoline.

Metal Carboxylate Dosage Optimization

Various treatment chemistries were tested on C1010 mild steel corrosion coupons in 1 L glass corrosion cells, at 40° C., 1 atm $CO_2$ constant blanket, for 3 days in synthetic water: NaCl (9.62%), $CaCl_2$ (0.305%)×$2H_2O$, $MgCl_2$ (0.186%)×$6H_2O$, and 250 ppm $NaHCO_3$. The treatment chemistries included an inhibitor, co-inhibitor and solvent. The inhibitor was stannous octoate. The co-inhibitor was TOFA/DETA imidazoline. The solvent was Aromatic 150.

Various treatment chemistries including stannous octoate, TOFA/DETA imidazoline and Aromatic 150 at various dosages were compared and are presented in the following Table 4.

TABLE 4

Treatment composition dosage optimization.

| Dosage (ppm) | TOFA DETA Imidazoline (wt %) | Stannous Octoate (wt %) | Aromatic 150 (wt %) | Corrosion Inhibition (%) |
|---|---|---|---|---|
| 10 | 7.5 | 2.5 | 90.0 | 58.19 |
| 25 | 7.5 | 2.5 | 90.0 | 97.86 |
| 50 | 7.5 | 2.5 | 90.0 | 99.10 |

As seen in Table 4, the treatment chemistry including stannous octoate 2.5 wt % and TOFA/DETA imidazoline 7.5 wt % performed best at higher dosages up to 50 ppm, with 25 ppm and 50 ppm chemistries both performing significantly better than the 10 ppm chemistry.

Rack Gunk Testing

A treatment chemistry including TOFA/DETA imidazoline (7.5 wt %), stannous octoate (2.5 wt %), mineral oil (25%), and Aromatic 150 (65 wt %) was subjected to a rack gunk test at 200° F. Loss (%) refers to carrier solvent evaporation. The results are shown in Tables 5 and 6 below.

TABLE 5

Treatment composition properties.

| | Physical State | Color | Clarity | Density (g/mL) | Density (lb/gal) | pH (Neat) | pH (10% in $H_2O$) |
|---|---|---|---|---|---|---|---|
| Quality Specification: | — | — | — | — | — | — | — |
| Test Result: | Liquid | Amber | Clear | 0.882 | 7.36 | 10.59 | 8.13 |

TABLE 6

Rack gunking test.

| | Loss (%) | Flowability | Separation | Precipitation |
|---|---|---|---|---|
| 5 min | 19.1 | Good | None | None |
| 10 min | 34.5 | Good | None | None |
| 20 min | 57.6 | Good | None | None |

These data suggest that there are no negative gunking properties associated with the disclosed treatment chemistry.

It will be appreciated that the above-disclosed features and functions, or alternatives thereof, may be desirably combined into different methods and compositions. Also, various alternatives, modifications, variations or improvements may be subsequently made by those skilled in the art, and are also intended to be encompassed by the disclosed embodiments. As such, various changes may be made without departing from the spirit and scope of this disclosure.

What is claimed is:

1. A method of suppressing corrosion of a corrodible metal surface that contacts a fluid stream in a hydrocarbon system, the method comprising:

introducing into the fluid stream a treatment chemistry including an organometallic corrosion inhibitor in an amount sufficient to provide a stable film on the metal surface, the stable film being effective to inhibit corrosion of the corrodible metal surface, the organometallic corrosion inhibitor comprising tin and an organic carboxylic acid;

measuring and monitoring a parameter of at least one of a surface demand of the corrodible metal surface and a system demand of the hydrocarbon system for the organometallic corrosion inhibitor;

controlling the amount of the organometallic corrosion inhibitor introduced into the fluid stream based on the measured and monitored parameter such that the organometallic corrosion inhibitor introduced into the fluid stream during treatment exceeds a baseline system demand of the hydrocarbon system for the organometallic corrosion inhibitor so that the sufficient amount of the organometallic corrosion inhibitor is available to form the stable film on the corrodible metal surface; and forming the stable film on the metal surface, wherein the treatment chemistry is introduced so that a concentration of the organometallic corrosion inhibitor in the fluid stream is in a range of 0.01 to 1,000,000 ppm.

2. The method of suppressing corrosion of a corrodible metal surface according to claim 1, wherein the organometallic corrosion inhibitor is a tin carboxylate compound.

3. The method of suppressing corrosion of a corrodible metal surface according to claim 2, wherein the tin carboxylate is stannous octoate.

4. The method of suppressing corrosion of a corrodible metal surface according to claim 1, wherein the organic carboxylic acid is a fatty acid selected from the group consisting of C4-C28 carboxylic acids, naphthenic acids, cyclic acids, maleic olefin copolymers, laureth acids, oxirane modified acids, ethoxylated acids, propoxylated acids, octoic acids, oleic acids, and neodecanoic acids.

5. The method of suppressing corrosion of a corrodible metal surface according to claim 1, wherein the treatment chemistry further comprises a co-inhibitor.

6. The method of suppressing corrosion of a corrodible metal surface according to claim 5, wherein the co-inhibitor is tall oil diethylenetriamine imidazoline.

7. The method of suppressing corrosion of a corrodible metal surface according to claim 1, wherein the treatment chemistry is introduced into the fluid stream by continuous treatment.

8. The method of suppressing corrosion of a corrodible metal surface according to claim 1, wherein the organometallic corrosion inhibitor is present in the fluid stream at a concentration in a range of 5 to 500 ppm.

9. The method of suppressing corrosion of a corrodible metal surface according to claim 1, wherein the organometallic corrosion inhibitor is present in the treatment chemistry at a concentration in a range of 0.1 to 25 wt %.

10. The method of suppressing corrosion of a corrodible metal surface according to claim 1, wherein the treatment chemistry is introduced into the fluid stream by batch treatment.

11. The method of suppressing corrosion of a corrodible metal surface according to claim 1, wherein the organometallic corrosion inhibitor is present in the fluid stream at a concentration in a range of 500 to 10,000 ppm.

12. The method of suppressing corrosion of a corrodible metal surface according to claim 1, wherein the organometallic corrosion inhibitor is present in the treatment chemistry at a concentration in a range of 25 to 100 wt %.

13. The method of suppressing corrosion of a corrodible metal surface according to claim 1, wherein the treatment chemistry is introduced directly to a corrodible metal surface by batch treatment.

14. The method of suppressing corrosion of a corrodible metal surface according to claim 1, wherein the organometallic corrosion inhibitor is present in the fluid stream at a concentration in a range of 25,000 to 1,000,000 ppm.

15. The method of suppressing corrosion of a corrodible metal surface according to claim 1, wherein the treatment chemistry is introduced so that a concentration of the organometallic corrosion inhibitor in the fluid stream is in a range of 1 to 100,000 ppm.

16. The method of suppressing corrosion of a corrodible metal surface according to claim 1, wherein the treatment chemistry is introduced so that a concentration of the organometallic corrosion inhibitor in the fluid stream is in a range of 1,000 to 50,000 ppm.

17. The method of suppressing corrosion of a corrodible metal surface according to claim 1, wherein the treatment chemistry is introduced so that a concentration of the organometallic corrosion inhibitor in the fluid stream is in a range of 2,000 to 30,000 ppm.

18. The method of suppressing corrosion of a corrodible metal surface according to claim 1, wherein the stable film provides a barrier to corrosion in absence of additional treatment chemistry being provided in the fluid stream.

19. The method of suppressing corrosion of a corrodible metal surface according to claim 1, wherein the parameter of the system demand is at least one of an online corrosion rate, oxidation reduction potential, and an oxygenation level.

20. The method of suppressing corrosion of a corrodible metal surface according to claim 1, wherein the controlling step includes controlling the amount of the organometallic corrosion inhibitor introduced into the fluid stream so as not to exceed a target range derived from the parameter of the system demand.

21. The method of suppressing corrosion of a corrodible metal surface according to claim 1, wherein a parameter of both the surface demand and the system demand are measured and monitored, and the amount of the organometallic corrosion inhibitor introduced into the fluid stream is controlled based on the parameters of the surface demand and the system demand.

22. The method of suppressing corrosion of a corrodible metal surface according to claim 1, wherein a parameter of both the surface demand and the system demand are measured and monitored to evaluate a total inhibitor demand, and the amount of the organometallic corrosion inhibitor introduced into the fluid stream is controlled based on the evaluation of the total inhibitor demand while the system is online.

* * * * *